United States Patent [19]

McCloud et al.

[11] 4,152,560

[45] May 1, 1979

[54] STATIONARY CONTACT STRUCTURE FOR HIGH VOLTAGE GAS BLAST CIRCUIT INTERRUPTER WITH DEFORMED SLOTTED CONTACT FINGER CONFIGURATION

[75] Inventors: James R. McCloud, Anaheim; Henry G. Meier, Glendale, both of Calif.

[73] Assignee: Gould Inc., Rolling Meadows, Ill.

[21] Appl. No.: 768,621

[22] Filed: Feb. 14, 1977

[51] Int. Cl.[2] ..... H01H 33/82

[52] U.S. Cl. ..... 200/148 R; 200/243; 200/252

[58] Field of Search ..... 200/243, 244, 252-261, 200/148 A, 148 R

[56] References Cited

U.S. PATENT DOCUMENTS

| | | | |
|---|---|---|---|
| 3,852,551 | 12/1974 | Cleaveland | 200/148 A |
| 3,970,811 | 7/1976 | Krebs | 200/148 A |
| 4,046,978 | 9/1977 | Badon | 200/148 A |
| 4,052,577 | 10/1977 | Votta | 200/148 A |

*Primary Examiner*—Robert S. Macon

*Attorney, Agent, or Firm*—Ostrolenk, Faber, Gerb & Soffen

[57] ABSTRACT

A stationary contact structure for a gas blast circuit interrupter consists of a conductive hollow cylinder which is slotted to define contact fingers, and the ends of the contact fingers are inwardly deformed so that the ends of the fingers closely abut one another to prevent inward deflection of the contact fingers to a degree which would exceed their elastic limit.

5 Claims, 7 Drawing Figures

STATIONARY CONTACT STRUCTURE FOR HIGH VOLTAGE GAS BLAST CIRCUIT INTERRUPTER WITH DEFORMED SLOTTED CONTACT FINGER CONFIGURATION

BACKGROUND OF THE INVENTION

This invention relates to high voltage gas blast circuit breakers, and more specifically relates to a novel stationary contact structure for the interrupter of a circuit breaker.

Gas blast circuit breakers are well known in the art and one typical gas blast circuit breaker is shown in U.S. Pat. No. 3,909,571, dated Sept. 30, 1975, in the name of Hansruedi Aumayer, and assigned to the assignee of the present invention. In a two pressure circuit breaker of this type, a plurality of circuit interrupters are connected in series with one another and each of the circuit interrupters includes a stationary contact defined by a cluster of flexible contact fingers which are engaged at their interior end by a movable contact rod.

In order to open the interrupter, the movable contact rod is withdrawn from the stationary contact finger cluster and the arc drawn between the two separating contacts is extinguished by a blast of electronegative gas, such as sulfur hexafluoride, which is released by the opening of a blast valve at the time the contacts open.

The stationary contact of the interrupter described in the above U.S. Pat. No. 3,909,571 is formed of a conductive cylinder which may be slightly conical in cross-section, and which is slotted from one end to define a circular cluster of individual contact fingers. Each finger is seperated from the other by a distance defined by the thickness of the slot used to form the individual fingers, which slot typically is defined by the saw cut thickness which forms the individual fingers. This slot thickness typically may be about 1/16 of an inch. The interior diameter of the ends of the individual contact elements is smaller than the external diameter of the movable contact which engages these finger ends. Therefore, when the movable contact enters the cluster of stationary contact fingers, the fingers are pressed outwardly, for example, by about 1/32 of an inch, so that each finger engages the stationary contact with substantial pressure created by the elastic forces tending to maintain the individual fingers in their unstressed position.

When the circuit breaker described above has been used for 63 kA interruption duty, it was found tht during arcing, one or more of the fingers could deform inwardly due to the forces created by the parallel arc currents flowing in adjacent fingers which tends to pull the fingers together. The deflection of the contact fingers over the full slot thickness caused the fingers to flex beyond their elastic limit, and permanently distorted the fingers, with their saw cut gaps being relatively closed at the outer ends of the fingers. When the fingers were permanently distorted inwrdly in this manner, the circuit breaker movable contact was unable to reclose since the circle formed by the stationary contact fingers was now too small to be entered by the movable contact.

BRIEF SUMMARY OF THE PRESENT INVENTION

In accordance with the present invention, a novel stationary contact configuration is formed in which a plurality of contact fingers are defined in a hollow cylinder of conductive material by a saw cut along the axis of the cylinder. the contact fingers are then permanently distorted inwardly toward one another until their ends are spaced from one another by less than about 1/32 of an inch and preferably such that they touch one another in their permanently distorted position. In this permanently distorted position, the internal diameter of the free end of the contact fingers is about 1/32 of an inch less than the outer diameter of the movable contact which cooperates with the stationary contact so that the movable contact can enter the circular cluster of contact fingers and obtain good contact pressure with the cluster of fingers by forcing them to elastically flex outwardly. Therefore, when the contacts separate, and arc current is drawn through the contacts, the arc current will cause the contacts to collapse toward one another, but this collapse is physically limited by the proximity of the adjacent contacts and cannot permanently distort the contacts beyond their elastic limit since the contacts will first contact one another to form a rigid contact cylinder.

DETAILED DESCRIPTION OF THE DRAWINGS

Figure 1:
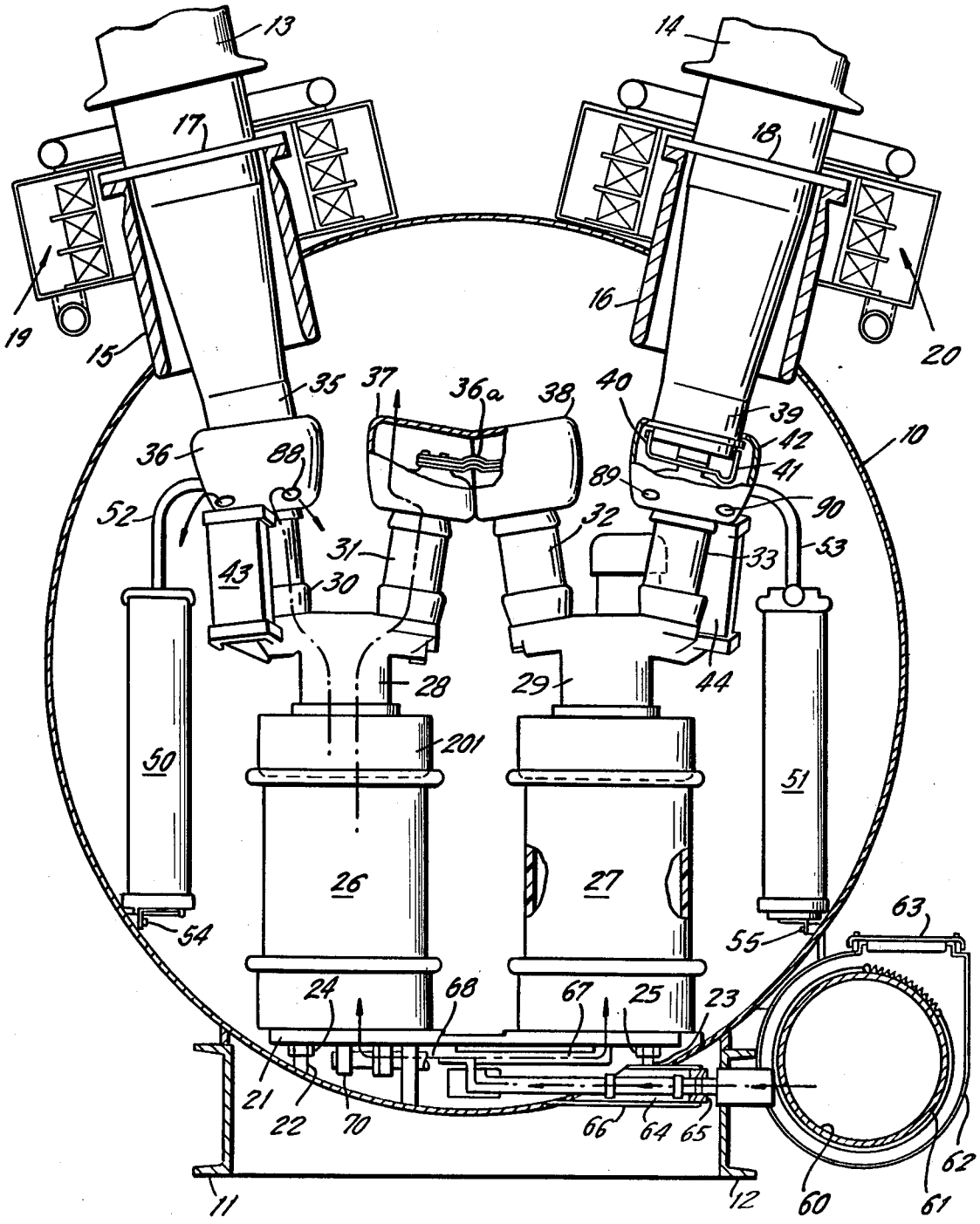
FIG. 1 is an elevational view of a circuit breaker which employs the novel contact of the present invention where a portion of the grounded support tank of the circuit breaker has been removed to expose the various components therein.

Referring first to FIG. 1, there is shown, in partial section, one phase of a high voltage circuit breaker which incorporates the present invention, as will be later described. The circuit breaker of FIG. 1 can, for example, be rated at 230,000 volts and at 63,000 amperes. Conventionally, the breaker will be a three-phase breaker and two other and identical phases to the one shown in FIG. 1 will also be provided.

In general, the circuit breaker phase of FIG. 1 is contained within a generally flattened spherical metallic tank 10 which is supported on metallic frame angle members 11 and 12. Angles 11 and 12 are suitably reinforced and extend rearwardly and support additional tanks to tank 10, which are spaced from the tank 10 and disposed generally parallel to tank 10 and constitute the other phases of the circuit breaker. The metallic tank 10 is a grounded housing and the circuit breaker shown herein for purposes of illustrating the invention is shown in a "dead tank" configuration.

The terminal bushings for the breaker may be of any standard type and are shown for illustration herein as including the bushings 13 and 14 which extend through cylindrical shrouds 15 and 16, respectively, which are appropriately welded or otherwise secured to the tank 10 and are sealed relative to the interior of the tank. Gas barriers 17 and 18, respectively, are provided to prevent the leakage of gas from tank 10. Thus, tank 10 is filled with sulfur hexafluoride gas (or a gas mixture which includes sulfur hexafluoride) at a pressure of about 3 atmospheres. For purposes of the invention, any dielectric gas at any appropriate pressure could be used. For the embodiment described herein, the gas pressure within tank 10 will be designated a relatively low pressure.

Each of the bushings 13 and 14 is further associated with current transformers 19 and 20, respectively, which may also be of any desired construction.

A grounded flat support platform 21 is contained within the tank 10 and is supported from the bottom of tank 10 by welded support members, such as bolts 22 and 23 and others not shown. Platform 21 sits on leveling nuts, such as nuts 24 and 25, respectively, of the support bolts. The platform 21 then serves as a level mount for the circuit interrupter equipment to be contained within tank 10. In the case of the breaker shown in FIG. 1, four interrupters are to be connected in series with one another to define the circuit breaker voltage rating of 230 KV. Platform 21 supports two spaced hollow tubular insulation support members 26 and 27, respectively, which further serve the purpose of high pressure gas reservoirs.

Each of the insulation support members 26 and 27 support, at their tops, respective blast valve housings 28 and 29 which, in turn, support series-connected interrupter units 30–31 and 32–33, respectively. Each of the interrupter units contains a pair of interrupter contacts which are simultaneously opened in the presence of a blast of gas which assists in extinguishing the arc. It is to be noted that the tubes 26 and 27, blast valve housings 28 and 29, and interrupters 30 to 33 are mechanically supported solely from the platform 21 and that none of these components are supported from the bushings 13 and 14 or intermediate supports for the interrupters 31 and 32.

The top of interrupter 30 is electrically connected to the stud 35 of terminal bushing 13 through a flexible connection, which will be later described. The connection between the top of interrupter 30 and stud 35 is then covered by a corona shield 36.

The bottom of interruptr 30 is then connected through housing 28 to the bottom of interrupter 31. The top of interrupter 31 is connected through flexible shunts **36*a* to the top of interrupter 32 with the tops of interrupters 31 and 32 and flexible connectors covered by corona shields 37 and 38**, respectively.

The bottom of interrupter 32 is then connected through the blast valve housing 29 to the bottom of interrupter 33. The top of interrupter 33 is in turn connected to the stud 39 of bushing 14 by flexible connectors, such as flexible connectors 40 and 41. The connection previously referred to between interrupter 30 and stud 35 incorporates flexible connectors, such as the connectors 40 and 41. The connection to stud 39 is then covered by the corona shield 42.

FIG. 1 also shows voltage distributing impedances 43 and 44 connected across interrupters 30 and 33, respectively. Note that any suitable arrangement of parallel-connected capacitors or resistors could be used across the various interrupters 30 to 33 in order to assure appropriate distribution of steady state and transient voltages across the series-connected breaks.

FIG. 1 illustrates the provision of transient recovery voltage capacitors 50 and 51 which are to be connected from either of the line sides of the breaker to ground. It will be noted that the flattened elliptical shape of tank 10 makes available free space in the outer central regions of the tank so that these capacitors can be mounted within this space without interference with the operation of the breaker or without interference with the dielectric integrity of the breaker.

It will be noted from FIG. 1 that the upper terminals of each of capacitors 50 and 51 are connected by relatively rigid conductors 52 and 53 to the tops of interrupters 30 and 33, respectively, and are directly and solidly connected to the bushing studs 35 and 39, respectively. The bottoms of capacitors 50 and 51 are then mechanically and electrically connected to the tank wall 10 by the support and grounding brackets 54 and 55, respectively.

The transient recovery voltage across the breaker is then controlled by the capacitors 50 and 51 in the manner generally set forth in U.S. Pat. No. 3,383,519, it being noted that each of capacitors 50 and 51 may have a value of approximately 0.0025 microfarads or any other desired value selected by the circuit designer.

The interior of the insulation reservoirs 26 and 27, which communicate with the blast valve housings 28 and 29 and thence to the interrupters 30 to 33 is at a relatively high pressure, such as 15 atmospheres of the same dielectric gas which fills tank 10.

The major pressure source for the breaker is an elongated cylinder 60 which is filled with gas at high pressure and which may be covered with a heater blanket 61 to ensure that the gas temperature will always be sufficiently high to maintain it in a gaseous state. A protective shroud 62 covers the cylinder 60 (which may extend the full length of all of the phases of the breaker), with portholes such as porthole 63 being available to permit maintenance of the cylinder 60 and the blanket 61. A suitable gas control system, which need not be described to understand the present invention, provides suitable gas conduits and gas controls to conduct gas from the cylinder 60 through the conduit 64 which passes through a sealing plug 65 in tube 66 which is secured to tank 10.

The high pressure conduit 64 then extends through a T-shaped member and into conduits 67 and 68 as generally outlined by the arrows, in FIG. 1, such that high pressure gas is admitted to the interior of insulation reservoirs 26 and 27. As will be later described, this gas is normally sealed at the blast valve housings 28 and 29 and high pressure gas is released through the interrupters 30 and 33 and into low pressure tank 10 only when the contacts of the interrupters are operated.

A suitable mechanical operating mechanism (not shown herein) is provided to mechanically actuate crank arms, such as crank arm 70 associated with tube 26, which drive operating rods which extend through the center of support tubes 26 and 27 and upwardly to blast valve housings 28 and 29. Similar crank arms will be associated with each of the other interrupters of each phase of the breaker. Any conventional operating mechanism, such as a spring operated mechanism or hydraulically operated mechanism is then connected to each of the crank arms so that all blast valves and contacts can be simultaneously operated to either open or close all interrupter contacts.

Figure 2:
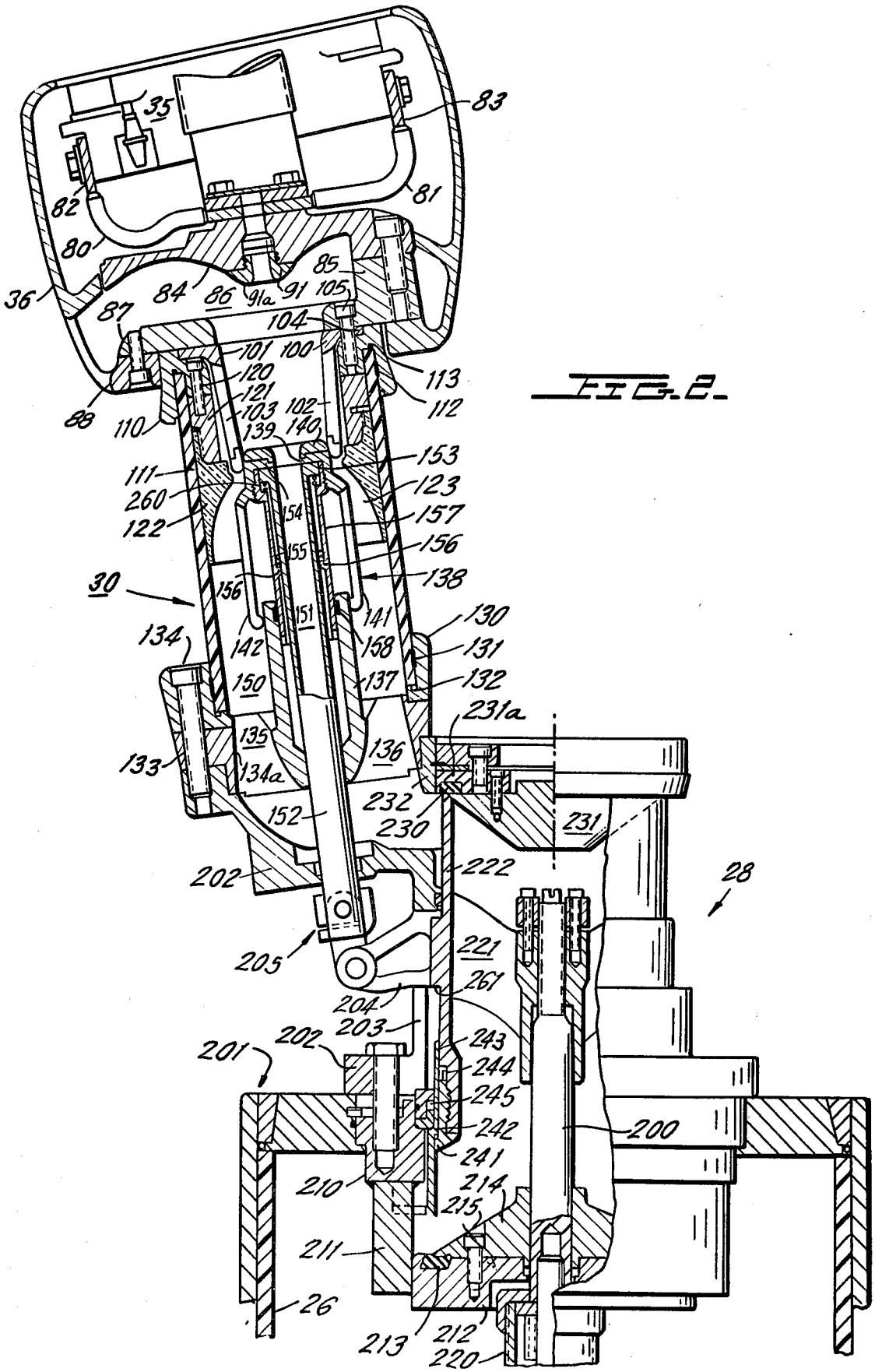
FIG. 2 is a cross-sectional view through one of the interrupters of the circuit breaker of FIG. 1 and illustrates the novel contact structure of the present invention.

The specific details of one interrupter structure, such as the interrupter 30 of FIG. 1 and a portion of the blast valve housing 28, are shown in FIG. 2. Referring now to FIG. 2, the interrupter and blast valve are shown in cross-section and at the top of FIG. 2. As will be later described, interrupters 30 to 33 are subassembled units which can be easily installed when the breaker is assembled. Thus, FIG. 2 shows two flexible shunts 80 and 81 which have upper connectors 82 and 83 which are appropriately bolted to the stud 35 of bushing 13, while the other ends of shunts 80 and 81 are bolted to an upper conductive adapter member 84 of the interrupter 30. Note that the stud 35 does not serve as a mechanical support for the interrupter components.

The upper adapter 84 is bolted to a second adapter portion 85 with the two components 84 and 85 defining a volume 86 which leads to discharge ports such as the discharge port 87 which is positioned adjacent a similar port 88 in the shield 36. Note the position of port 88 in FIG. 1.

Additional ports are distributed around the periphery of shield 36 which lead to similar openings defined between adapter members 84 and 85. Two further ports of this general type are shown in FIG. 1 for shield 42 as the ports 89 and 90.

The adapter member 84 further serves to threadably receive a tubular arcing terminal 91. Note that arcing terminal 91 has an opening 91*a* therethrough which extends upwardly so that some arc venting can be directly vertically upward along the axis of the opening in arcing terminal 91.

The use of flexible shunts to make the connection from the top of interrupter 30 to the terminal bushing stud 35 is made possible since the entire mass of interrupter structure 30 is supported on top of the blast valve housing 28.

Figure 2A:
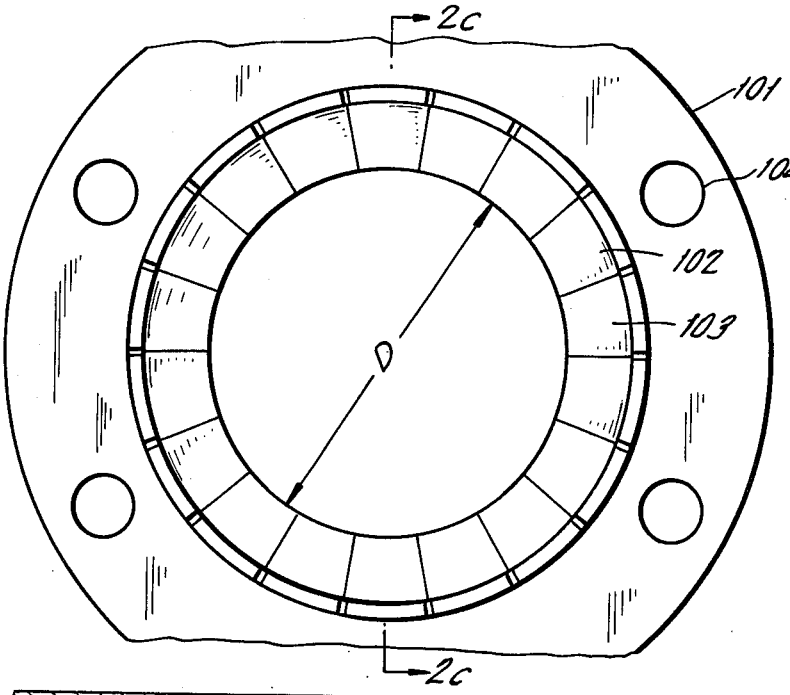
FIG. 2*a* is a top plan view of the novel stationary contact of FIG. 2.
Figure 2C:
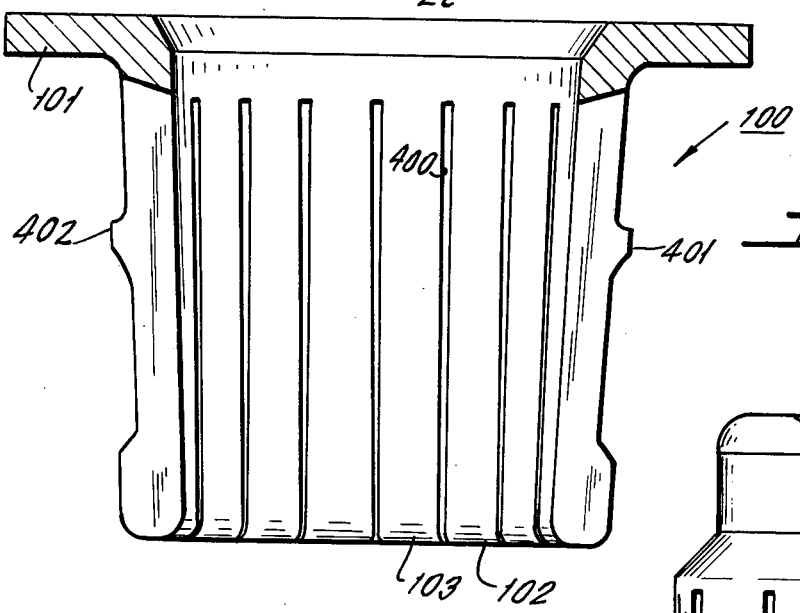
FIG. 2*c* is a cross-sectional view of FIG. 2*a* taken across the section lines 2*c*—2*c* in FIG. 2*a*.

The interrupter 30 of FIG. 2 contains an elongated, generally tubular stationary contact member 100 which has an upper solid ring-shaped end 101 and slots which form segmented contact fingers, such as fingers 102 and 103 in its other end. The segmented fingers of contact 100 are also shown in FIGS. 2*a* and 2*c*. It will be further noted that the ends of the segmented contacts, such as segmented finger contacts 102 and 103, terminate with arcing contact inserts which may have been formed as an insert ring which was brazed to the tubular contact member before the tubular member was slotted to form the segmented finger.

FIG. 2*a* further illustrates openings such as opening 104 in the solid flange 101 which accepts the bolts, such as bolt 105 which secures the stationary contact to adapter member 85. The bolts which pass through the openings in flange 101 of stationary contact 100 are threaded into a conductive ring 110 which clamps the end side of flange 101 against adapter member 85. Ring 110 serves as an upper support for the insulation tube 111 which is the interrupter housing tube. Tube 111 may be made of any desired material, such as an epoxy reinforced glass tube or the like. The upper end of tube 111 is suitably secured to and sealed with respect to ring 110 as by the securing key 112 and sealing ring 113.

A set of bolt openings is formed in the inner diameter of ring 110 and these bolt openings receive bolts, such as bolt 120, which threadably engage ring member 121 and hold it in position. The exterior lower portion of ring 121 is threaded and threadably receives the insulation baffle 122 which may be of a suitable arc-resistant material such as Teflon, and serves as a guide for blast gases during the opening operation of the interrupter, and as a means to protect or shield tube 111 from the hot gases created during arc interruption. Baffle 122 also contains a plurality of thin, axially directed and circumferentially spaced fins, such as fin 123. These fins then prevent the formation of a vortex in the gas blast which is guided by baffle 122.

The lower end of insulation tube 111 is fixed in a conductive support ring 130 and is fixed therein and sealed thereto as by the key 131 and sealing ring 132. The ring 130 is, in turn, secured to a spider plate 133 as by bolts, such as bolt 134, where the spider plate is formed of a conductive disk 134*a* having radially extending web sections such as sections 135 and 136 which are joined to a centrally extending hollow conductive shaft 137. The shaft 137 then slidably receives the segmented movable contact 138 which is slidably engaged with the outer surface of shaft 137.

The movable contact 138 consists of a generally tubularly shaped member having a solid ring-shaped end 139 which receives a solid arcing ring 140, with the lower end of contact 138 being segmented to form separate contact fingers, such as fingers 141 and 142.

Figure 2B:
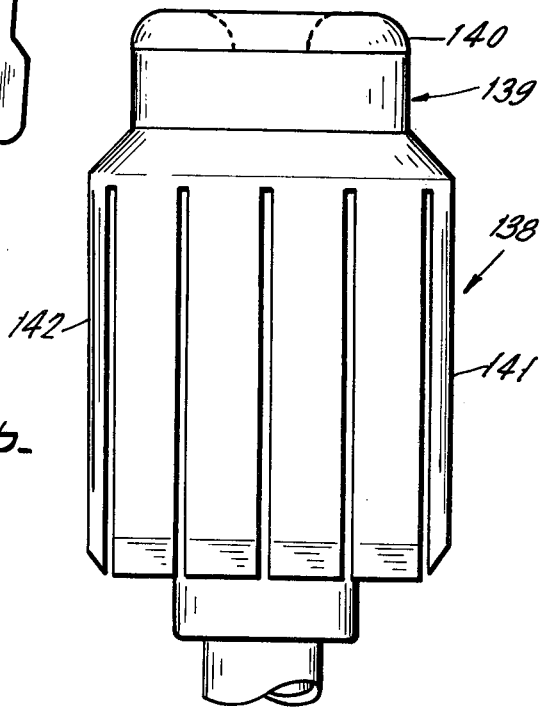
FIG. 2*b* is a side plan view of the movable contact of FIG. 2.

FIG. 2*b* shows a side plan view of the movable contact 138. The segmented finger elements 138 and 142 along with other similar fingers are flexed outwardly from their normal relaxed position, and are therefor biased inwardly and into sliding engagement with the outer surface of shaft 137. The solid upper end 139 of movable contact 138 is movable into and out of engagement with the segmented fingers, such as fingers 102 and 103 of stationary contact 100. When the segmented fingers 102 and 103 engage the contact 100, they are elastically flexed outwardly to inherently provide contact pressure to form a good low resistance contact.

It will be noted, during contact operation, that the baffle 122 will lead high pressure gas up from the annular volume 150 which surrounds movable contact 138 and into the baffle 122 and then between the separating contacts 138 and 100. The gas will also flow in two directions through the arc, both through the center of stationary contact 100 and the opening in arc terminal 91, and through the central opening in contact 138 shown as opening 151.

The movable contact 138 is connected to an operating shaft 152 (which contains the opening 151) and the upper end of shaft 152 is provided with flange 153. The flange 153 is engageable with the rear surface 154 of the movable contact 138 and also receives a compression spring 155. The compression spring 155 is seated at its bottom on a ledge 156 of a spring retaining cylinder 157 which is threadably secured within the upper end of contact 138. The bottom of cylinder 157 slides within the interior of conductive tube 137 and slides on a seal 158 within the shaft 137. The operation of the interrupter contacts described above will be later described after the blast valve arrangement and support of the interrupter from the blast valve housing 28 is described.

As is shown in FIG. 1, the blast valve housing 28 supports both interrupters 30 and 31. One lateral half of the blast valve housing 28 is shown in FIG. 2 insofar as it relates to the support of interrupter 30. It will be noted, however, that the blast valve housing 28 is symmetric so that the same structure shown in connection with interrupter 30 is provided on the opposite side of the center line 200 in FIG. 2 for the support and operation of the interrupter 31.

The insulation support member 26 of FIG. 1 is partly shown in FIG. 2 and it is seen that a metal end cap 201 is fitted over and sealed to the top of insulation tube 26.

The metal cap 201 then serves as the support for the conductive support casting 202 of the blast valve housing 26. Casting 202 is provided with a slot 203 therein for passing an arm 204 which is appropriately connected to the operating shaft 152 by the adapter fitting 205.

Cap 201 further serves to support ring 210 and circumferentially distributed posts such as posts 211 which are welded to ring 210. The posts 211 are then welded to a valve seat plate 212 which carries the cut-off valve ring 213 of the blast valve as will be later described. The valve ring 213 is then held in position by a clamp 214 which is clamped into engagement with ring 213 by bolts such as bolt 215.

The main operating rod 220, which extends from the crank 70 of FIG. 1 then extends through plate 212 and clamping member 214 (in sealed relation therewith) and is connected to radiating arms, such as arm 221 of the blast sleeve 222. Note that sleeve 222 also carries the operating arm 204.

The upper end of blast valve sleeve 222 is engageable with upper blast valve seal 230 which is clamped in position by the clamping plate 231*a*. The ring-shaped valve seal 230 is carried on plate 231 which is generally supported by a ring 232 which is an integral portion of the casting 202.

The main blast valve sleeve 222 extends downwardly and is threadably secured to ring-shaped member 240 which has an outwardly projecting flange 241. Flange 241 is engageable with a shoulder 242 on an auxiliary sliding sleeve 243. Note that suitable sliding seals 244 and 245 seal these sliding surfaces against pressure loss of high pressure gas which is in the interior of cap 201.

THE STATIONARY CONTACT STRUCTURE OF THE PRESENT INVENTION

As is best shown in FIGS. 2*a* and 2*c*, the novel contact structure of the present invention differs from the prior art type of stationary contact structure in that the slots which define the individual contact fingers are permanently distorted at their free ends so that the individual contact fingers touch one another at their outer ends. Thus, as shown in FIGS. 2*a* and 2*c*, each of the contact fingers, such as contact fingers 102 and 103, which are defned by the slot 400, touch one another at their outer ends.

If the contact fingers do not touch one another in the manner shown, they should be spaced from one another by no greater than about 0.008 inches. In the permanently distorted form shown in FIGS. 2*a* and 2*c*, the inner diameter D defined by the cluster of identical contact fingers will be about 0.056 inches less than the movable contact diameter which engages the interior of the contact fingers.

Figure 2E:
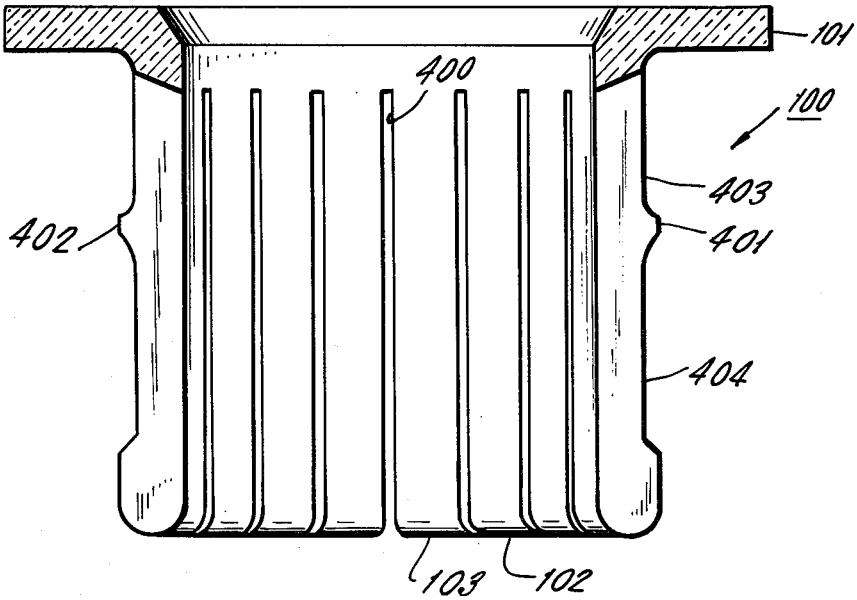
FIG. 2*e* is a cross-sectional view of FIG. 2*d* taken across section lines 2*e*—2*e* in FIG. 2*d*.
Figure 2D:
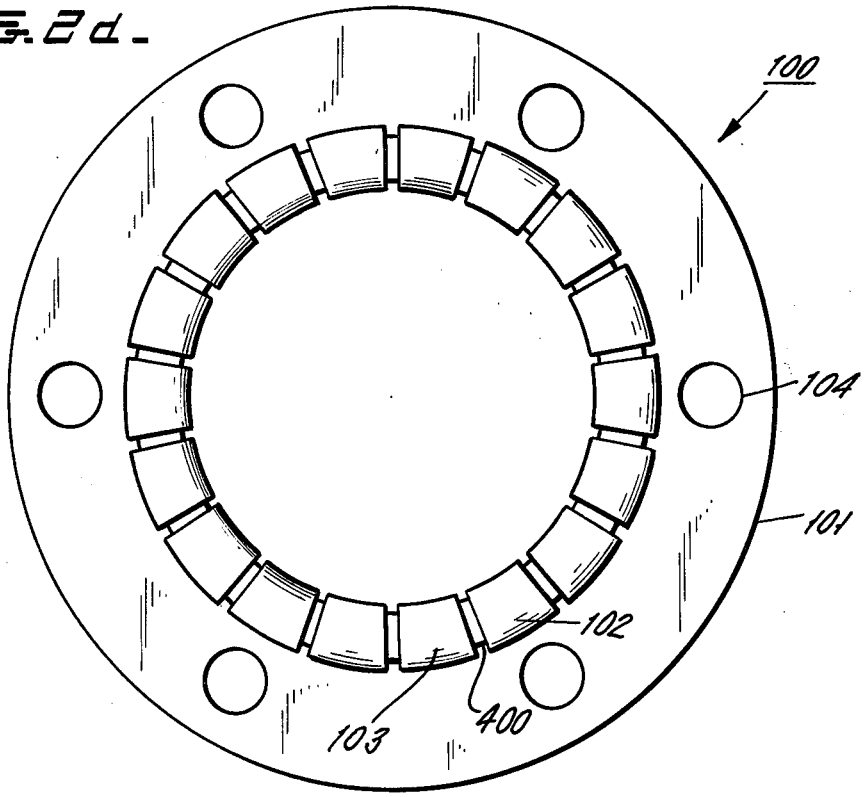
FIG. 2*d* is a top view of the contact before the contact fingers have been deformed toward one another as shown in FIG. 2*a*.

In forming the eighteen fingers shown in the contact of FIGS. 2*a* and 2*c*, and as shown in FIGS. 2*d* and 2*e*, eighteen slots, which are each 1/16 inch wide, including the slot 400, were cut into the conductive cylinder which had a diameter of about 2-¾ inches and a radial thickness of about ¼ inches. The fingers were then bent inwardly in a suitable die and bent beyond their elastic limit and until their resulting internal diameter at their free end was about 0.056 inches than the moving contact diameter. This circular opening, defined by the contact fingers, may be lapped with a suitable lapping tool until the inner diameter of the circular cluster is about 2.329 inches to develop about a 0.023 inches lift for each contact finger when it is engaged by the movable contact.

In order to permit a forming tool to engage the contact fingers and distort them permanently inwardly toward one another, each of the contact fingers is provided with an outer projection, shown as projections 401 and 402, which projections are formed by machined sections 403 and 404 in the tubular cylinder which is used to form the stationary contact finger cluster.

In forming the contact fingers of FIGS. 2*d* and 2*e*to the permanently distorted shape of FIGS. 2*a* and 2*c*, it was found that the base flange 101 of the contact was distorted so that, when the contact was bolted into position, the contacts would separate undesirably. Therefore, and to prevent this from occurring, the base flange 101 is also preferably distorted or cupped by from about 0.005 inches to 0.015 inches so that, when the flange 101 is bolted into position, the proper spacing will be maintained between the free ends of the various fingers or the space will be entirely closed.

It is now possible generally to describe the operation of the interrupter and blast valve of FIG. 2. With the components in the position shown, the interrupter is closed and a current path is formed from terminal bushing stud 35 through the flange shunts 80 and 81 and into the adapter members 84 and 85 and the stationary contact 100. The current then transfers from stationary contact 100 into the movable contact 138 and the contact fingers 141 and 142 and into the conductive tube 137. From the conductive shaft 137 the current passes through casting 202 and then to interrupter 31 which is also supported on the blast valve housing 28. The current then proceeds through the interrupters 31, 32 and 33 in the same manner and exits at bushing 14.

While the breaker is closed, the high pressure gas from within the insulating support tube 26 fills the volume defined by the annular open gap between the bottom seal 213 and sleeve 243 and upwardly within sleeve 222 and up to the valve seat 230. the interior 30 is at the relatively low pressure of the interior of tank 10, as contrasted to the high pressure which is held at the valve seat 230.

In order to open the circuit breaker, the circuit breaker operating mechanism (not shown) is actuated to cause all of the operating rods, such as operating rod 220 to move simultaneously. The downward movement of rod 220 causes the sleeve 222 to move downwardly thereby to open the seal between the upper end of sleeve 222 and the valve seat 230. This permits the high pressure gas within sleeve 222 to move into the chamber which contains spider members 135 and 136 and upwardly through the annular channel 150 within the insulation tube 111. Thus, the pressure within the annular volume 150 begins immediately to increase.

At the same time, the downward movement of sleeve 222 causes the shaft 152 to move downwardly and, initially, the upper flanged end 153 of shaft 152 will cause the spring 155 to begin to compress. This introduces an increasing downward force on the seal sleeve 157 and thus on the movable contact 138 which is connected to sleeve 157. Initially, however, the contact 138 does not move since the frictional forces between the segmented fingers, such as fingers 141 and 142 of the movable contact against the outer surface of shaft 137 and the frictional force between upper contact end 139 and the segmented contacts of the stationary contact 100 are sufficiently high to prevent contact motion. Ultimately, however, the spring force becomes sufficiently high as to drive the movable contact 138 downwardly, thereby causing the separation of the contact 138 from the segmented fingers of the stationary contact 100 with a snap action. Note that eventually the flange 153 will pick up shoulder 260 of sleeve 157 if the movable contact does not begin to move under the force of the compression spring 155 alone.

As the contact tip 140 separates from the arcing contact finger portions of the segmented stationary contact 100, an arc is drawn between them. Substantial gas pressure has already been established within chamber 150 and high pressure gas may begin to flow between the separating contacts even prior to inception of the arc as when the contact separation is somewhat delayed by the lost motion connection between shaft 152 and the movable contact 138.

As the contacts 100 and 138 separate, sulfur hexafluoride or a similar interrupting gas passes rapidly through the annular region of contact separation with a portion of the gas flowing into channel 151 and another portion of the gas flowing upwardly and through the central opening in arc terminal 91. The majority of the gas, however, is blasted into the interior of tank 10 through openings in the shield 36 such as the port 88 in FIG. 2.

As the contacts separate, the upper arc root will seat on the arc terminal 91 and the lower arc root will extend from the arcing tip 140. The arc is quickly extinguished under the influence of the rapidly moving sulfur hexafluoride gas.

At the time the arc is extinguished, the sleeve 222 has moved sufficiently downward so that the shoulder 261 in the outside of the sleeve 262 has picked up the lower sleeve 243 so that the sleeve 243 is moved downwardly and into engagement with valve seat 213. This operation then cuts off the further flow of high pressure gas from the interior of cap 201 toward the interrupter, thereby to conserve the high pressure gas in the reservoir.

In order to reclose the breaker, the operating rod 220 is moved upwardly so that the contact operating rod 152 moves upwardly to reclose the contacts. Little or no gas blast is necessary during the closing operation. Therefore, there is a time delay in the re-opening of the blast valve. Thus, the sleeve 243 remains sealed against seal 213 until sleeve 222 and its outwardly facing extension 241 move to a sufficiently high position that extension 241 engages the shoulder 242 of sleeve 243. At this point, the lower valve seat 213 is opened so that gas can flow for the very short time until the upper end of sleeve 222 seats against seal 230.

Although a preferred embodiment of this invention has been described, many variations and modifications will now be apparent to those skilled in the art, and it is therefore preferred that the instant invention be limited not by the specific disclosure herein but only by the appended claims.

The embodiments of the invention in which an exclusive privilege or property is claimed are defined as follows:

1. In a circuit interrupter, a hollow stationary contact, and a relatively movable contact operable to make sliding pressure engagement with the interior of said stationary contact, and operating means for moving said movable contact into and out of sliding pressure engagement with said hollow stationary contact; said stationary contact comprising a generally hollow cylindrical conductive body; said cylindrical conductive body having a plurality of circumferentially spaced, radial slots extending therethrough and extending along the length of said cylindrical body from one end of said body to a region near the opposite end of said cylindrical body, thereby to define a plurality of integral, separately flexible contact fingers; each of said contact fingers being permanently deformed inwardly toward the axis of said cylindrical body, whereby each of said fingers is closer to an adjacent finger at their free end at said one end of said cylindrical body than at longitudinally central regions of and at the end of said fingers adjacent said opposite end of said cylindrical body, whereby the maximum inward movement of said fingers until all of said fingers engage one another to define a minimum fixed diameter opening is an elastic deformation; said movable contact having a tubular region greater in outer diameter than the inner diameter defined by said ends of said contact fingers of said one end of said cylindrical body by an amount to cause elastic spreading of said contact fingers when said movable contact engages said stationary contact; each of said radial slots gradually reducing in spacing between adjacent fingers and over their full length by at least one-half from the base of said slots adjacent said opposite end of said cylindrical body to said one end of said cylindrical body.

2. The circuit interrupter of claim 1 wherein each of said contact fingers has an arcing contact tip at their free ends.

3. The circuit interrupter of claim 1 wherein said cylindrical body has a generally conical cross-section.

4. The circuit interrupter of claim 1 wherein said cylindrical body has a mounting flange fixed to and integral with said opposite end of said cylindrical body.

5. The circuit interrupter of claim 4 wherein said mounting flange is slightly dished, whereby, when said flange is fastened to a flat surface, said contact fingers tend to press inwardly of said cylindrical body.

* * * * *